US007331508B2

(12) United States Patent
Kanter et al.

(10) Patent No.: US 7,331,508 B2
(45) **Date of Patent: *Feb. 19, 2008**

(54) STACKABLE CONTAINER WITH SUPPORT FLANGES

(75) Inventors: Allen Kanter, Malvern, PA (US); Peter S. Jaffe, Philadelphia, PA (US); Brian J. Tibbels, Levittown, PA (US)

(73) Assignee: Innovative Packaging Designs L.P., Montgomeryville, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/234,864

(22) Filed: Sep. 23, 2005

(65) Prior Publication Data

US 2006/0124507 A1 Jun. 15, 2006

Related U.S. Application Data

(63) Continuation of application No. 10/359,349, filed on Feb. 5, 2003, now Pat. No. 6,948,617.

(60) Provisional application No. 60/354,419, filed on Feb. 5, 2002, provisional application No. 60/359,125, filed on Feb. 22, 2002.

(51) Int. Cl.
*B65D 5/20* (2006.01)
*B65D 17/28* (2006.01)

(52) U.S. Cl. ..... 229/169; 229/160; 229/178; 229/185.1; 229/242

(58) Field of Classification Search ..... 229/160, 229/168, 169, 178, 185.1, 915, 919
See application file for complete search history.

(56) References Cited

U.S. PATENT DOCUMENTS 1,256,437 A * 2/1918 Careaga ..... 206/8
2,465,324 A * 3/1949 De Mian ..... 229/125.08
2,536,384 A * 1/1951 Meller ..... 229/182
2,555,581 A * 6/1951 Dunning ..... 229/160
2,556,915 A * 6/1951 Guyer ..... 229/132
2,698,124 A * 12/1954 Hines ..... 229/122
2,925,211 A * 2/1960 Frankenstein ..... 229/167

(Continued)

FOREIGN PATENT DOCUMENTS

GB 2220406 A * 11/1990 ..... 229/164
GB 2232403 A * 12/1990 ..... 229/169

*Primary Examiner*—Gary E Elkins
(74) *Attorney, Agent, or Firm*—Synnestvedt & Lechner, LLP

(57) ABSTRACT

A container is disclosed having a plurality of interconnected panels forming sidewalls surrounding a central space. Flaps extend from lower sidewall edges and fold along fold lines to form a bottom. Support flanges are arranged along upper sidewall edges on oppositely facing sidewalls. The support flanges are oriented at right angles to the sidewalls and provide a support surface allowing the containers to be stacked one atop another without collapsing or nesting within each other. Each support flange is supported by a truss formed by a panel segment extending angularly from the support flange to a support panel biased against the sidewall to which the support flange is attached by a retaining flap extending from an inner sidewall layer. Locking tabs at the ends of each panel segment are received within recesses positioned in sidewall panels perpendicular to the support flanges. The container is transformed from a knockdown formed from a unitary blank.

21 Claims, 10 Drawing Sheets

U.S. PATENT DOCUMENTS 3,034,697 A * 5/1962 Frankenstein ..... 229/169
3,106,332 A * 10/1963 Dieguez ..... 229/168
3,143,275 A * 8/1964 Diggs ..... 229/160
3,325,003 A * 6/1967 Bilezerian ..... 206/494
4,055,293 A * 10/1977 Stramaglia ..... 229/176
4,058,249 A * 11/1977 Buck ..... 229/178
4,133,474 A * 1/1979 Hall ..... 229/122.33
4,293,091 A * 10/1981 Gerard ..... 229/117.16
4,413,769 A * 11/1983 Michetti ..... 229/120.17
4,537,344 A * 8/1985 Thomas ..... 229/169
4,613,045 A * 9/1986 Watson ..... 206/512
4,702,409 A * 10/1987 Osborne ..... 229/125
5,277,360 A * 1/1994 DeMott ..... 229/122
5,337,950 A * 8/1994 Bower ..... 229/164
5,415,344 A * 5/1995 Harrelson ..... 229/169
5,489,061 A * 2/1996 Fogle et al. ..... 229/109
5,505,368 A * 4/1996 Kanter et al. ..... 229/122.32
5,791,555 A * 8/1998 Kanter ..... 229/164
5,957,294 A * 9/1999 Kanter ..... 206/774
6,158,653 A * 12/2000 Kanter et al. ..... 229/185.1
6,168,027 B1 * 1/2001 Esser ..... 206/738
6,189,778 B1 * 2/2001 Kanter ..... 229/122.1
6,189,780 B1 * 2/2001 Kanter ..... 229/164
6,948,617 B2 * 9/2005 Kanter et al. ..... 229/178

* cited by examiner

FIG. 6
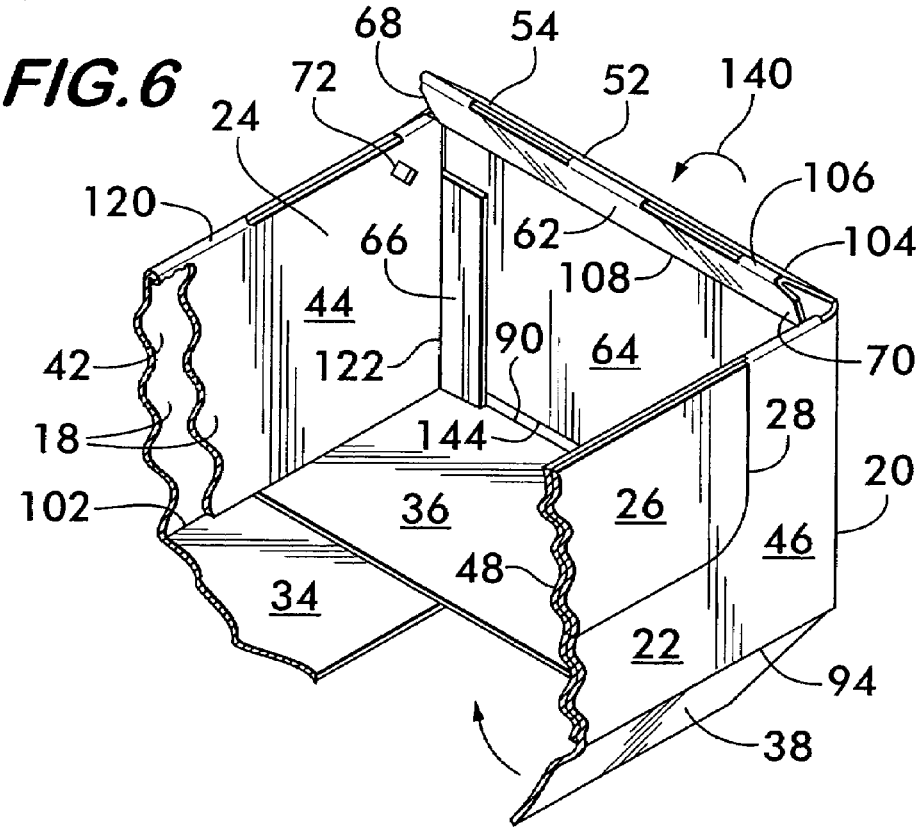
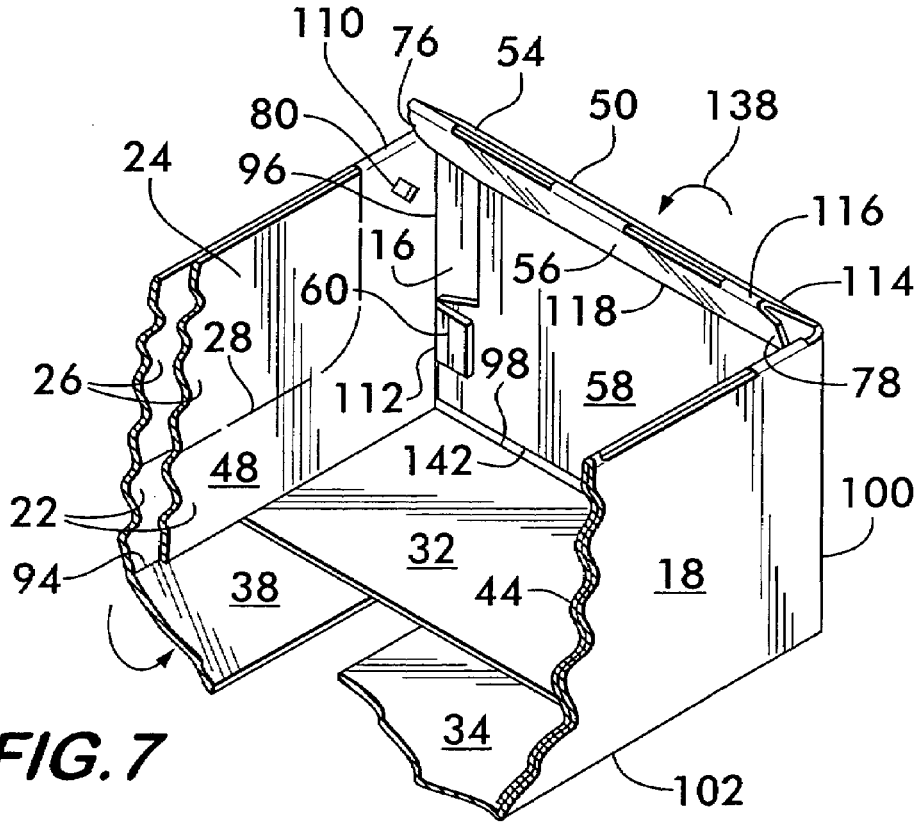
FIG. 7

FIG.8
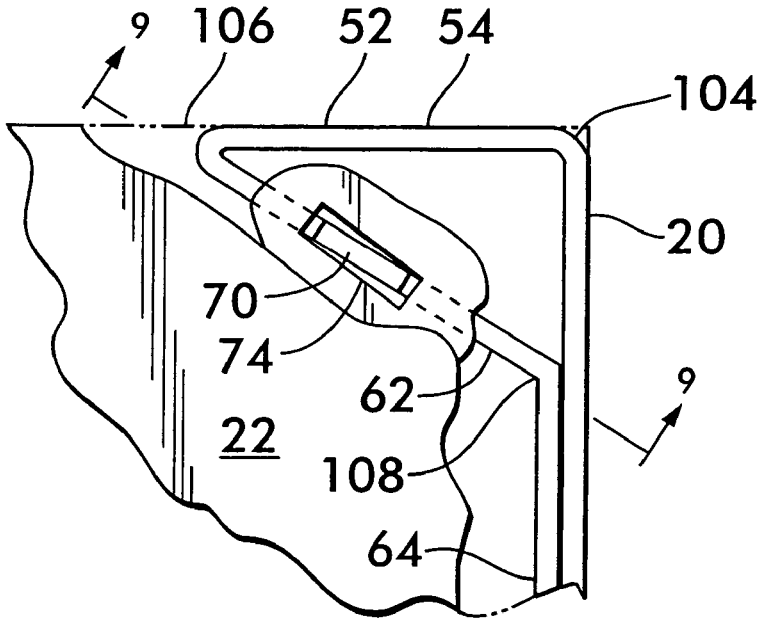
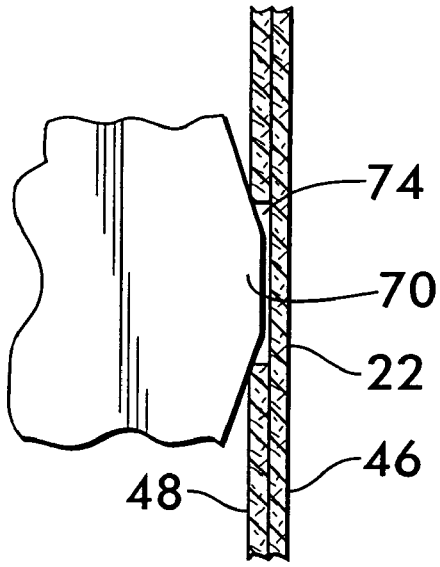
FIG.9

STACKABLE CONTAINER WITH SUPPORT FLANGES

RELATED APPLICATION

This application is based on and claims the benefit of U.S. Provisional Application No. 60/354,419, filed Feb. 5, 2002, and U.S. Provisional Application No. 60/359,125 filed Feb. 22, 2002.

FIELD OF THE INVENTION

The invention relates to containers used for packaging, shipping and displaying goods. More particularly, the invention relates to display containers such as corrugated paperboard boxes having flanges to facilitate the stacking of such containers on top of one another.

BACKGROUND OF THE INVENTION

Display containers, for example, boxes of corrugated paperboard, are widely used for shipping and marketing products. Such containers are especially containers of candy are shipped to the store in stacked form. Store personnel remove the tops of the containers and, in many cases, fold down or remove a side display panel from the container which exposes the candy within the container to view and allows access thereto by the consumer. The containers are then stacked one on top of another on the retail floor for display of the candy to the consumer.

A major problem with stacked containers having open tops and sides is that a container may partially fall into or "nest" within the container beneath it. Another problem is the lack of strength for stacking. All too often loaded containers near or at the bottom of a stack collapse or become misshaped under the weight of the containers above them. This impairs the aesthetic appearance of the display sought by the seller, ruins the products within and requires clean up.

One known container, disclosed in U.S. Pat. No. 5,791,555, provides a shelf like flap to help support a container stacked on top and prevent nesting. This container is configured to automatically pull the shelf into position upon the assembly of the container. One end of the shelf is connected to a side wall of the container to pull the shelf down, the other end being free and typically resting on the top of one of the side walls. While this container provides advantages over other type containers, further improvements are believed desirable. For example, many products, such as candy, are drop loaded into the containers. If the shelf is already in place, this can interfere with the loading process. Furthermore, it has been found that in some uses the free end of the shelf can be forced into the container, creating a nesting problem.

SUMMARY AND OBJECTS OF THE INVENTION

The invention concerns a container upon which another container having similar dimensions may be stacked without nesting of the containers one within another. The container comprises a plurality of panels attached to one another along adjacent edges to form a plurality of sidewalls surrounding a central space. A plurality of flaps extend from the sidewalls inwardly toward the central space. The flaps are positioned substantially co-planarly in one of overlapping and adjacent positions relative to one another to form a bottom. A support flange is attached to a first of the sidewalls along an edge thereof positioned opposite to the bottom. The support flange is oriented parallel to the bottom and has an edge extending inwardly toward the central space. A support panel is positioned in overlying engagement with the first sidewall and faces the central space. The support panel has a bottom-engaging edge. A panel segment extends angularly from the support panel and is attached to the edge of the support flange. The panel segment and the support panel support the support flange and prevent rotation thereof toward the bottom. The support flange thereby provides support to the containers when stacked one atop another.

The invention also concerns support surfaces useable on containers to permit stacking of the containers one atop another without nesting. The containers comprise a plurality of interconnected panels forming sidewalls surrounding a central space. The sidewalls have flaps extending therefrom which are foldable to form a bottom. A first and a second of the sidewalls facing one another in opposing relationship have first and second support flanges respectively attached to them. The support flanges extend lengthwise along edges of the first and second sidewalls in spaced relation to the bottom. Each support flanges is oriented at a right angle to the first and second sidewalls respectively and have an edge projecting inwardly toward the central space. First and second support panels are positioned respectively in overlying engagement with the first and second sidewalls. Each of the support panels have a bottom engaging edge. First and second panel segments extend respectively from the first and second support panels and are respectively attached to the edges of the first and second support flanges. The panel segments and the support panels support the support flanges and prevent rotation thereof toward the bottom. The support flanges thereby provide support to the containers when stacked one atop another.

Accordingly, one object of the present invention is to provide a display-ready container with improved anti-nesting capabilities.

Another object is to provide a container with anti-nesting capabilities that can be assembled by machine.

Another object is to provide a display-ready container that is economical to produce.

A further object of the present invention is to provide a display-ready container that is easy to assemble and use.

Another object is to provide a display-ready container that can be safely stacked during shipping and display.

Additional objects, advantages and novel features of the invention will be set forth in part in the description which follows, and in part will become apparent to those skilled in the art upon examination of the following, or may be learned from making and using the invention. The objects and advantages of the invention may be realized and attained by means of the combinations pointed out in the appended claims.

BRIEF DESCRIPTION OF THE DRAWINGS

FIGS. 4 through 7 are perspective views of a container being formed from a knockdown shown in FIG. 3;

FIG. 6 is a perspective cross-sectional view taken at line 6 of FIG. 5;

FIG. 7 is a perspective cross-sectional view taken at line 7 of FIG. 5;

FIG. 8 is a partial cut-away view taken from within the broken circle shown in FIG. 1 and on an enlarged scale;

FIG. 9 is a sectional view taken at line 9 of FIG. 8;

DETAILED DESCRIPTION OF THE PREFERRED EMBODIMENT

Figure 1:
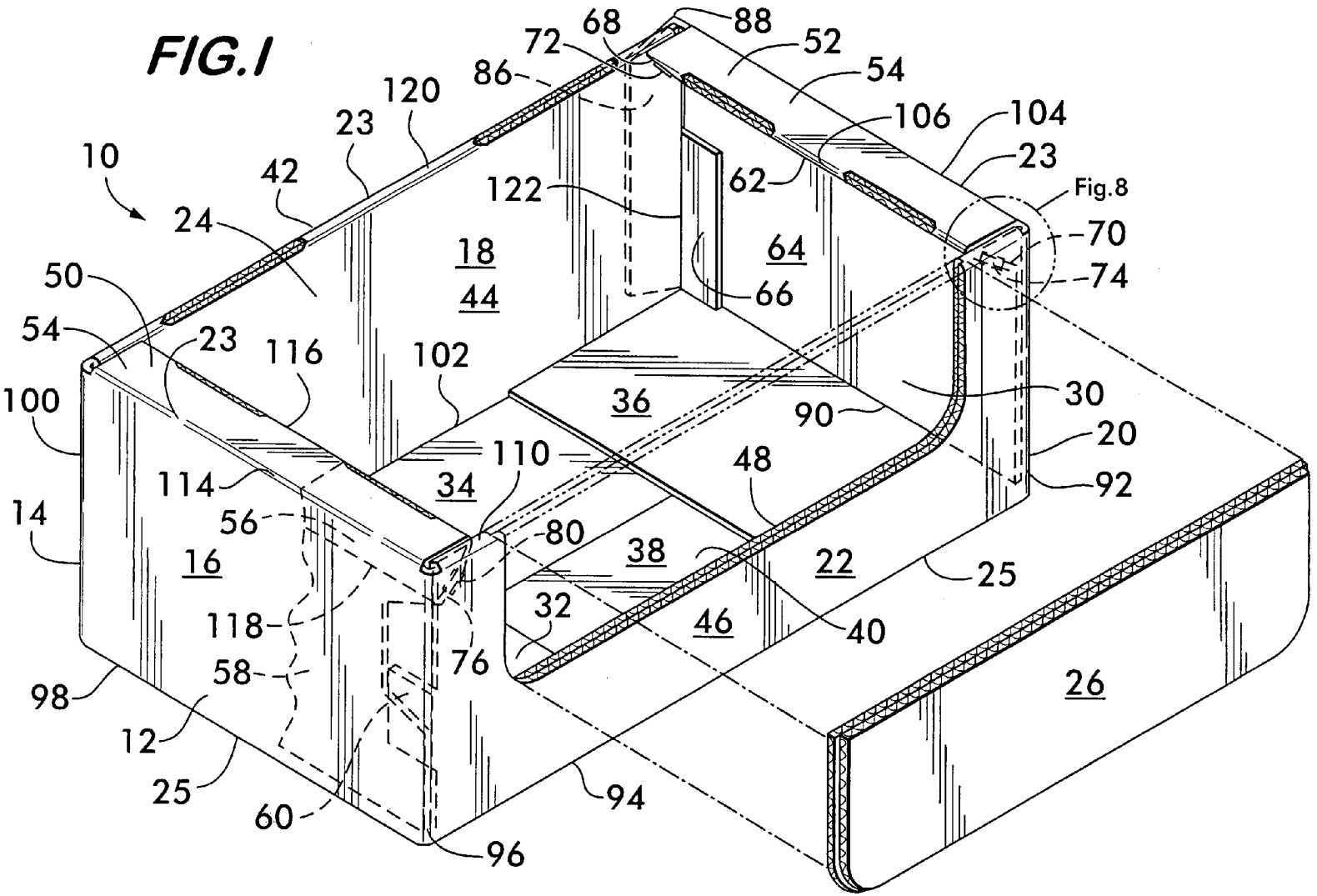
FIG. 1 is a perspective view of a container according to the invention.

FIG. 1 shows a container 10 according to the invention. Container 10 is preferably formed of a stiff, lightweight substrate such as corrugated paperboard and comprises a plurality of panels 12 attached to one another along adjacent edges 14 to form a plurality of sidewalls 16, 18, 20 and 22. The sidewalls surround a central space 24 where merchandise is received for storage, transport and display. The sidewalls have an upper edge 23 and a lower edge 25. Container 10 is depicted without a top as it might be seen in a display at a market. Sidewall 22 preferably has a removable panel portion 26 defined by a plurality of interconnected perforations 28 (see FIG. 2), the panel portion 26 being shown removed to provide an opening 30 in the container 10 allowing display and access to the goods therein even when another container is stacked atop container 10.

Flaps 32, 34, 36 and 38 extend respectively from each sidewall 16, 18, 20 and 22 and are folded inwardly toward the central space 24 along respective fold lines (identified in detail below) to form a bottom 40. Upon folding, the flaps 32, 34, 36 and 38 are positioned substantially co-planarly in overlapping and adjacent positions relatively to one another. There are several possible folding combinations used to form bottoms of containers, such as the 1-2-3-4 bottom or the "crash" bottom, all of which are known to those of skill in the art.

Preferably, opposing sidewalls 18 and 22 are formed by two layers of substrate. The outer layer 42 of sidewall 18 is attached to neighboring sidewalls 16 and 20. The inner layer 44 is attached to outer layer 42 along a fold line 120 and is reverse folded along this fold line so that the layers 42 and 44 are in overlying relation. Similarly, sidewall 22 is formed by outer layer 46 which is attached to sidewalls 16 and 20. The inner layer 48 is attached to outer layer 46 along a fold line 110 and is reverse folded along this fold line into overlying relation with layer 46. Sidewalls such as 18 and 22 having two layers are stronger, yielding higher burst strength and crush strength and, thus, allow containers 10 to be stacked to greater depth.

Generally, the sidewalls, flaps and other parts comprising the container 10 are joined together at adjacent edges defined by fold lines formed in the substrate comprising the container. For containers made of corrugated paperboard, the fold lines may be formed in any of a number of ways, such as by cutting, creasing or perforating the paperboard as is known in the art. For economy of reference herein, when an edge of a part of the container is defined by a fold line, both the fold line and the edge are denoted by the same reference character. This does not imply, however, that all edges are necessarily fold lines or that all parts of the container need be joined at fold lines in the substrate.

As shown in FIG. 1, container 10 has support flanges 50 and 52 which form support surfaces 54 across the tops of the containers upon which other containers can sit when the containers are stacked. The support flanges 50 and 52 prevent nesting of the containers within one another when stacked and also strengthen the container sidewalls against collapse. Preferably, the support flanges 50 and 52 extend across the entire width or length of the container and are respectively positioned on opposing sidewalls such as 16 and 20. Support flanges 50 and 52 are substantially the same, and the description of support flange 50 below may be applied to support flange 52 as well.

Support flange 50 is preferably integrally formed with its sidewall 16 and extends from a sidewall edge 114 located opposite to the bottom 40 of the container. The support flange 50 is oriented parallel to the bottom 40, thus, positioning support surface 54 to engage and support a container stacked on top of container 10. As best shown in FIG. 7, support flange 50 has an edge 116 which extends inwardly toward the central space 24. A panel segment 56 is attached to support flange 50 along edge 116. Panel segment 56 is angularly oriented with respect to support flange 50 and is attached along another edge 118 to a support panel 58 which is positioned in overlying engagement with sidewall 16. Support panel 58 is positioned facing the central space 24 and has a free edge 142 which engages the bottom 40 when the support flange is parallel to the bottom. Preferably, panel segment 56 and support panel 58 are integrally formed with support flange 50, the edge 116 between the support flange 50 and the panel segment 56 as well as the edge 118 between the panel segment 56 and the support panel 58 being defined by fold lines allowing the various parts to bend relatively to one another as described below. Preferably, support panel 58 is biased against or is retained adjacent to the sidewall 16 by a retaining flap 60, which extends from an edge 112 of the inner layer 48 of sidewall 22 toward the opposite side wall 18. Retaining flap 60 keeps the support panel 58 positioned against sidewall 16 but allows the support panel to slide over the sidewall. This feature facilitates assembly of the container from a knockdown as described below and also helps stiffen the support panel and prevent buckling. It also allows the support flange 50 and support panel 58 to move into their assembled positions without disturbing the items packed inside the container.

FIG. 6 shows the other support flange 52 which is attached to sidewall 20. A panel segment 62 is attached to an edge 106 of support flange 52 which extends inwardly toward the central space 24. A support panel 64 is attached to another edge 108 on the panel segment 62, the support panel 64 having a bottom engaging free edge 144. A retaining flap 66 extends from an edge 122 of the inner layer 44 comprising sidewall 18. The retaining flap 66 keeps the support panel 64 positioned against the sidewall 20, but allows the support panel to slide over the sidewall. The retaining flaps 60 and 66 may be positioned in any corner of the container, those positions shown being by way of example only. Note that retaining flap 60 and support panel 58 are different, respectively, from retaining flap 66 and support panel 64. The reason for the differences is explained below.

As best shown in FIG. 6, panel segment 62 has locking tabs 68 and 70 extending outwardly from each end of the panel segment, the edges being respectively adjacent to and facing sidewalls 18 and 22. The inner layers 44 and 48 respectively comprising the sidewalls have recesses such as 72, shown in FIG. 6, and 74, shown in FIGS. 8 and 9, which are sized and positioned to receive the locking tabs 68 and 70 respectively to lock the support flange 52 into position parallel to bottom 40. Similarly, as shown in FIG. 7, panel segment 56 also has locking tabs 76 and 78 which engage recesses 80 and 82 (not shown) in inner layers 48 and 44.

As shown in FIG. 8, the panel segment 62 and support panel 64 cooperate to support the support flange 52 in the manner of a truss when loaded with a container stacked on support surface 54. Support flange 50 is supported in a similar manner by panel segment 56 and support panel 58. The truss structure provides excellent strength resulting in relatively high stacking capacity and prevention of nesting of stacked containers.

Figure 2:
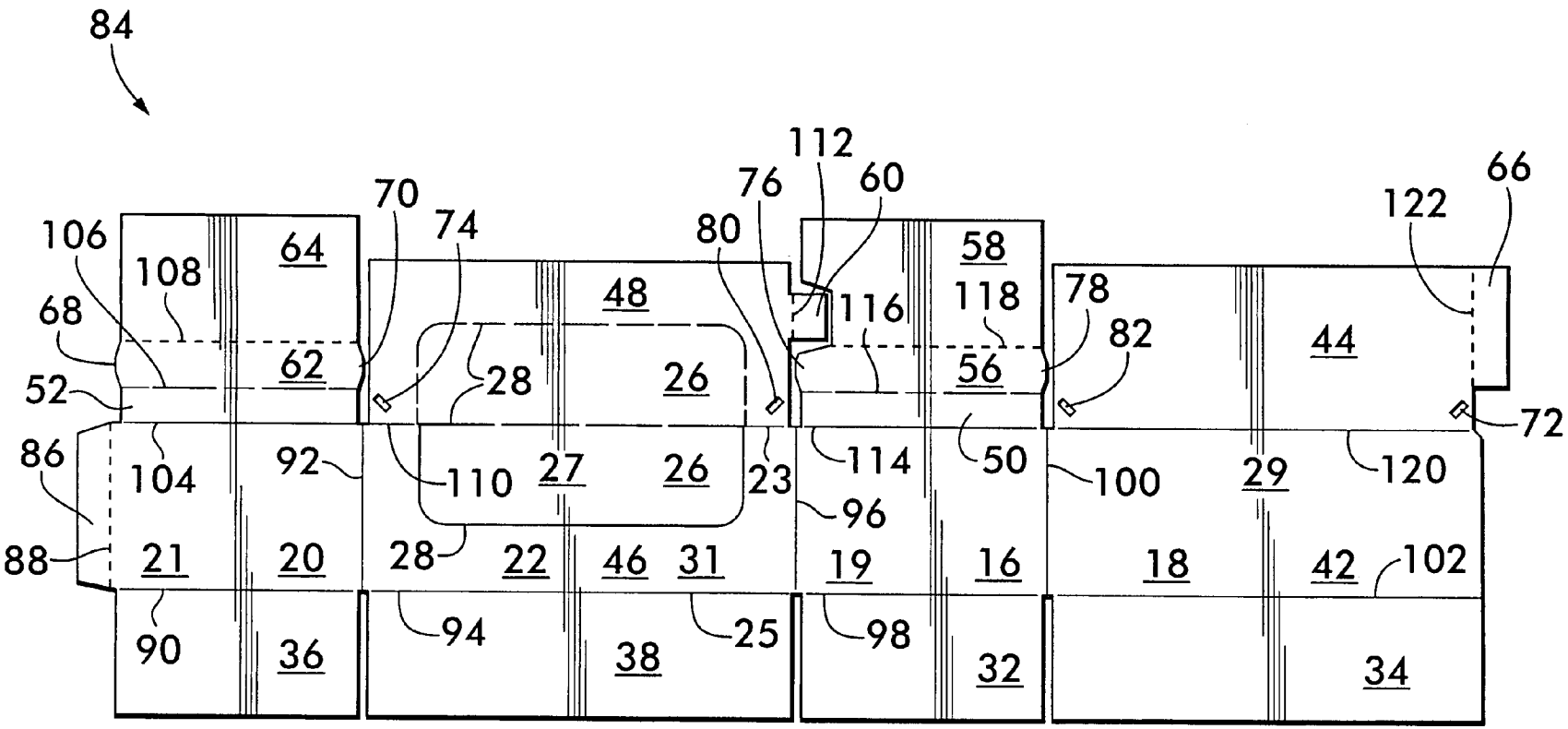
FIG. 2 is a plan view of a blank from which the container shown in FIG. 1 is formed.

Container 10 is preferably formed from a unitary substrate blank 84, shown in FIG. 2. The substrate blank 84 is preferably die-cut from a sheet of corrugated paperboard during which the fold lines defining the panel edges are formed, by creasing, perforating and cutting operations as described above. Sidewalls 16, 18, 20 and 22 are shown as they would appear after the blank 84 is cut from the paperboard sheet. The surfaces visible in FIG. 2 comprise the inwardly facing sidewall surfaces of the container 10 in FIG. 1.

Moving from left to right in FIG. 2 across blank 84, there is an attachment flap 86 joined to sidewall 20 along an edge defined by a fold line 88. Sidewall 18 is joined to sidewall 20 to form the container 10 by attaching attachment flap 86 to sidewall 18 (see FIG. 1). Attachment is preferably by adhesive, although fasteners such as staples may also be feasible. Flap 36 extends from a lower edge of the sidewall 20, that edge being defined by a fold line 90. Sidewall 20 is joined to sidewall 22 at an edge defined by a fold line 92. Flap 38 extends from a lower edge of sidewall 22, that edge being defined by fold line 94. Sidewall 22 has a removable panel portion 26 defined by perforations 28. The perforations allow the panel portion 26 to be removed for access to the central space 24 once the container 10 is formed. Sidewall 22 is joined to sidewall 16 along an edge defined by a fold line 96. Flap 32 extends from a lower edge of sidewall 16, that edge being defined by a fold line 98.

Sidewall 16 is joined to sidewall 18 along an edge defined by a fold line 100. Flap 34 extends from a lower edge of sidewall 18, that edge being defined by a fold line 102.

Moving again from left to right in FIG. 2, support flange 52 extends from an upper edge of sidewall 20, that edge being defined by a fold line 104. Support flange 52 preferably runs along the entire length of sidewall 20. Panel segment 62 is attached to support flange 52 along an edge defined by a fold line 106. Locking tabs 68 and 70 are positioned respectively at each end of the panel segment 62. Support panel 64 is attached to panel segment 62 at an edge defined by a fold line 108.

Sidewall 22 is formed from outer layer 46 to which the inner layer 48 is attached along an upper edge defined by a fold line 110. Note that both inner and outer layers 48 and 46 have the removable panel portion 26 defined by the perforations 28. Recesses 74 and 80 are positioned in inner layer 48. Retaining flap 60 is attached to inner layer 48 along an edge partially defined by a fold line 112. When laid out on the substrate forming blank 84, retaining flap 60 encroaches on adjacent support panel 58. If blank 84 is to be a unitary blank, then retaining flap 60 must be cut out from substrate material which would otherwise comprise support panel 58. However, the material available for retaining flap 60 is limited if support flange 50 is to extend across the entire width of sidewall 16. Therefore, retaining flap 60 is limited in size as compared with its counterpart retaining flap 66 described below.

Support flange 50 extends from an upper edge of sidewall 16, that edge being defined by a fold line 114. Support flange 50 preferably runs along the entire length of sidewall 16. Panel segment 56 is attached to support flange 50 along an edge defined by a fold line 116. Support panel 58 is attached to panel segment 56 along an edge defined by a fold line 118.

Sidewall 18 is formed by outer layer 42 to which is attached inner layer 44 along an edge defined by a fold line 120. Recesses 82 and 72 are positioned in inner layer 44. Retaining flap 66 is attached to inner layer 44 of sidewall 18 along an edge defined by a fold line 122. Note that there is no inherent limit to the size of retaining flap 66 since it is cut from the substrate near the end of the blank 84.

Figure 3:
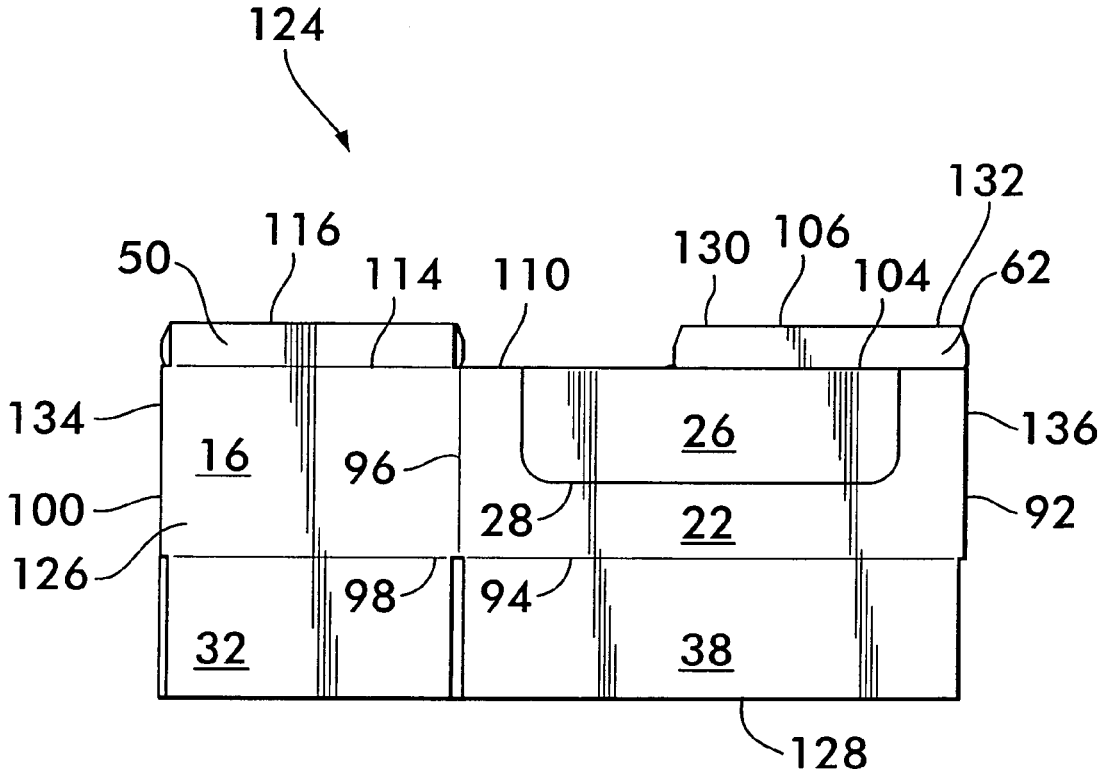
FIG. 3 is a knockdown formed from the blank shown in FIG. 2 and transformable into the container shown in FIG. 1.
Figure 4:
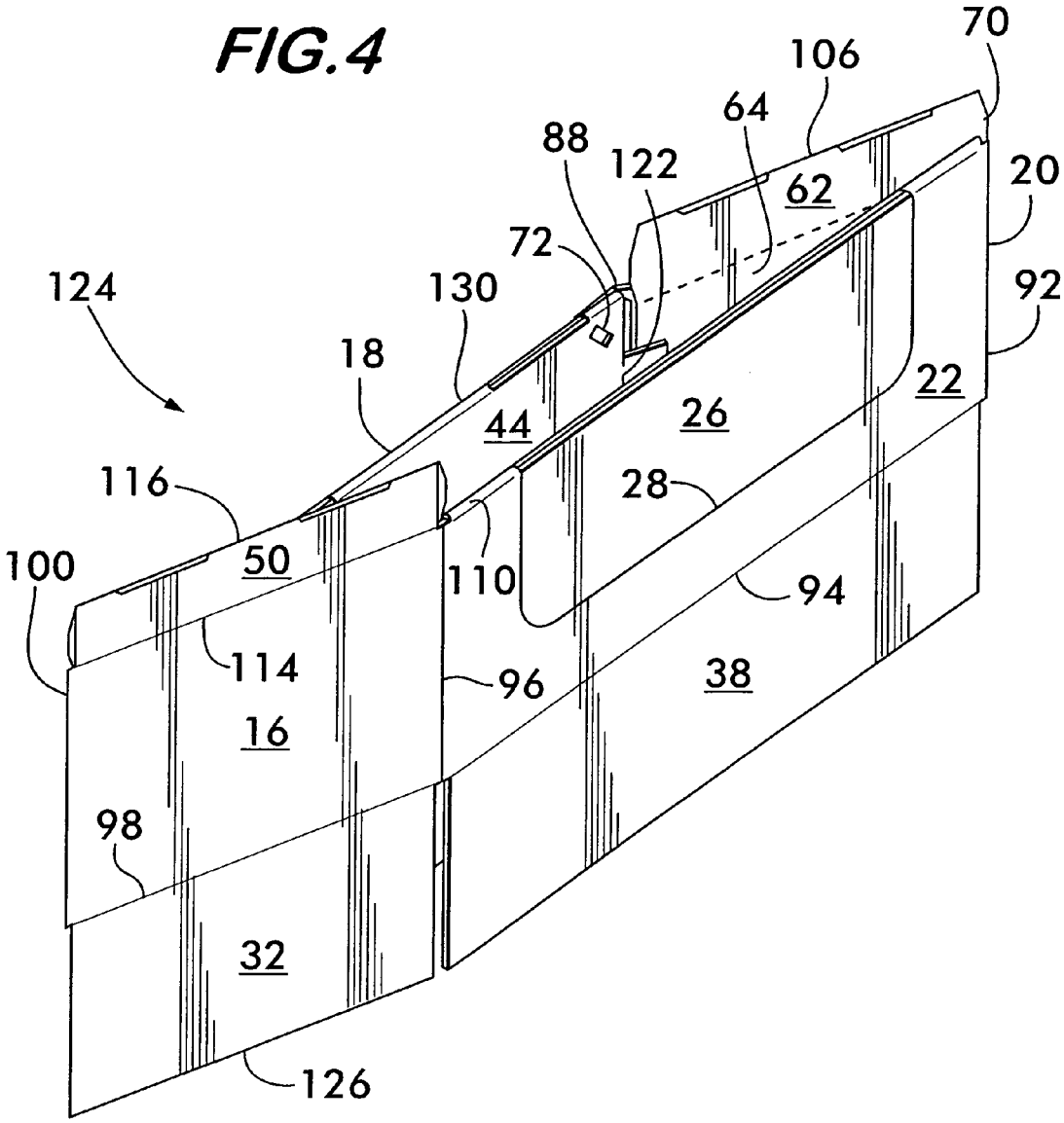
Figure 5:
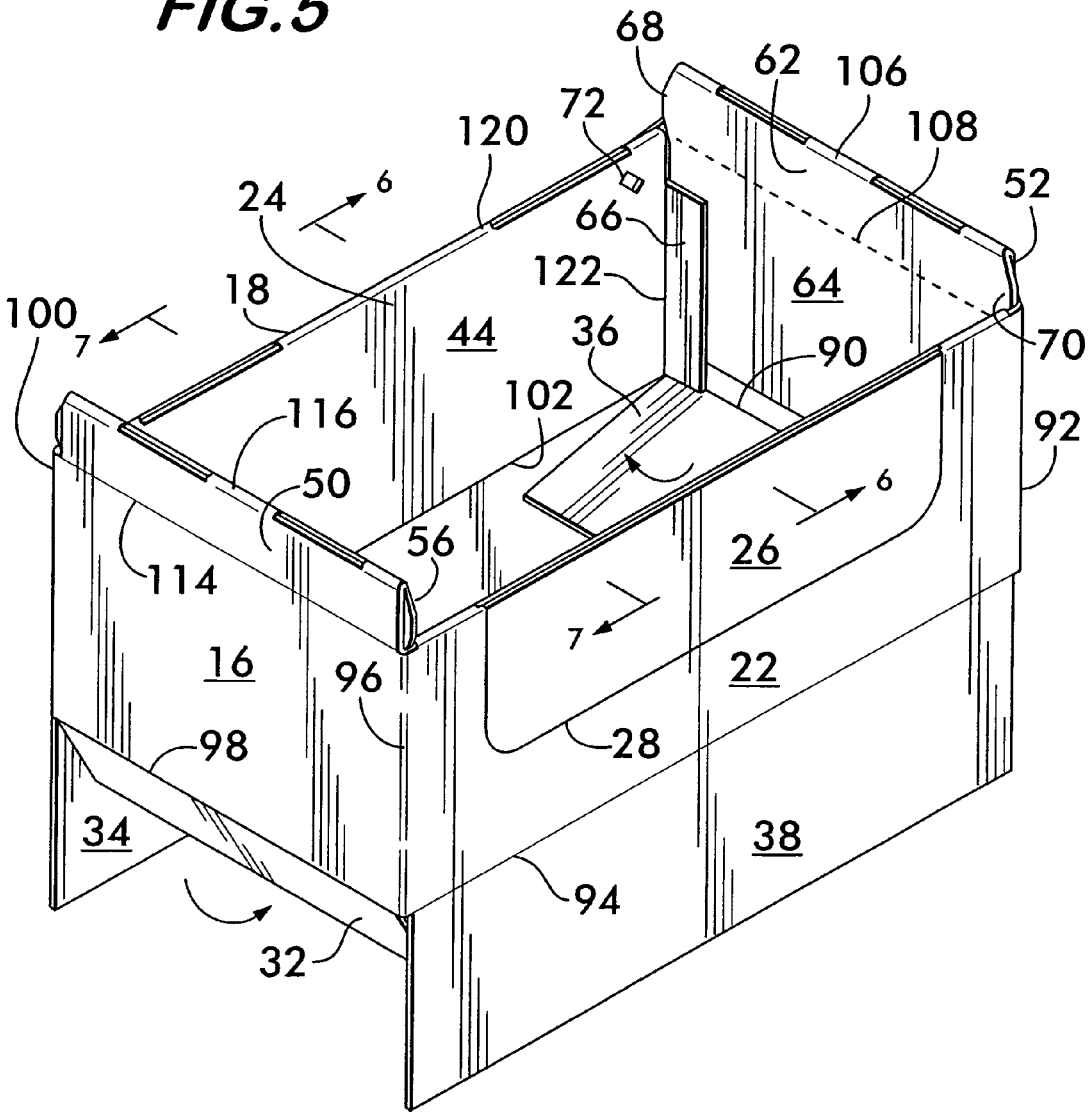

Blank 84 is next formed into a knockdown 124 shown in FIG. 3. The knockdown is advantageous because it allows containers such as 10 to be shipped from the manufacturer in a flat configuration, saving space and reducing shipping costs. The knockdown is configured to be conveniently converted from the flat configuration into the container 10 as depicted in FIG. 1 through a series of simple steps (described below) performed by automated machinery. Once the container is formed from the knockdown, it is then loaded with merchandise, final actions are executed, and the container with its contents is ready for shipment.

With reference to FIG. 2, knockdown 124 is formed by reverse folding panel segments 56 and 62 along with their respective attached support panels 58 and 64 about respective fold lines 116 and 106 to bring the support panel 58 in overlying relation with the inner face 23 sidewall 16 and support panel 64 in overlying relation with the inner face 25 of sidewall 20. Similarly, inner layers 48 and 44 are reverse folded about respective fold lines 110 and 120 to bring inner layer 48 into overlying relation with the inner face 27 of outer layer 46 to form sidewall 22, and inner layer 44 into overlying relation with the inner face 29 of outer layer 42 to form sidewall 18. During reverse folding, care is taken to ensure that support panel 58 is sandwiched between sidewall 16 and retaining flap 60.

Next, sidewall 18 along with flap 34 is reverse folded about fold line 100 to bring the sidewall into overlying relation with the inner faces 23 and 31 of sidewalls 16 and 22 and the flap into overlying relation with flaps 32 and 38. Note that this action brings inner layer 44 into facing relation with support panel 58, panel segment 56, and inner layer 48 of sidewall 22. Sidewall 20 along with flap 36 is then reverse folded about fold line 92, bringing support panel 64 and panel segment 62 into facing relation with inner layer 48 of sidewall 22, and flap 36 into overlying relation with flap 38. Care is taken that support panel 64 is sandwiched between sidewall 20 and retaining flap 66 during folding. The folding action of sidewall 20 brings attachment flap 86 into engagement with outer layer 42 of sidewall 18. The attachment flap 86 is secured to the sidewall 18 to complete the knockdown 124, shown in FIG. 3.

Knockdown 124 comprises a first knockdown wall 126 which includes sidewall 16, flap 32, support flange 50, sidewall 22, and flap 38 in a substantially same first plane 128. Note that support panel 58, panel segment 56 and inner layer 48 (all not shown) may also be considered part of the first knockdown wall 126 and to reside substantially in first plane 128. Knockdown 124 also comprises a second knockdown wall 130, located behind knockdown wall 126 and therefore not visible in FIG. 3, but formed of sidewall 18, flap 34, sidewall 20, flap 36 and support flange 52 all substantially in a same second plane 132 parallel to plane 128. Support panel 64, panel segment 62 and inner layer 44 may also be considered part of knockdown wall 130 and substantially in second plane 132. Knockdown wall 126 is joined to knockdown wall 130 at first and second knockdown corners 134 and 136 respectively defined by fold lines 100 (between sidewalls 18 and 16) and 92 (between sidewalls 20 and 22).

FIGS. 4 through 7 show a series of steps performed to transform the knockdown 124 into the container 10. In the first step, shown in FIG. 4, the first and second knockdown walls 126 and 130 are separated from one another with the sidewalls 16, 18, 20 and 22 pivoting relatively to one another in the manner of a four bar linkage about fold lines 88, 92, 96 and 100. As the sidewalls comprising the respective knockdown walls 126 and 130 move outwardly, they are no longer substantially in the same planes 128 and 132 and the knockdown 124 transforms into the configuration shown in FIG. 5 wherein adjacent sidewalls are oriented at right angles to one another.

Once the sidewalls 16, 18, 20 and 22 are moved into the right angled configuration, the flaps 32, 34, 36 and 38 are folded inwardly toward the central space 24 along respective fold lines 98, 102, 90 and 94 to form the bottom 40. In the example shown in FIGS. 5, 6 and 7, flaps 32 and 36 are first folded inwardly (FIG. 5) followed by flaps 34 and 38 (FIGS. 6 and 7), the latter two flaps 34 and 38 being preferably adhesively bonded to the first two to form a permanent bottom. Other bottom configurations are of course feasible, as known in the art.

With sidewalls 16, 18, 20 and 22 in right-angle relation and bottom 40 formed, the container 10 is now ready to be loaded with merchandise. It is advantageous to perform the loading step before the support flanges 50 and 52 are folded into the final configuration shown in FIG. 1. This allows for a maximum sized opening in the container for receiving the contents.

In the next step, shown in FIGS. 6 and 7, the support flanges 50 and 52 are folded inwardly about respective fold lines 114 and 104 toward the central space 24 as indicated by arrows 138 and 140 to provide the support surfaces 54 which strengthen the sidewalls and support a container stacked on top of the container 10 without allowing nesting of the containers. Upon folding as shown in FIG. 7, support flange 50 causes support panel 58 to slide downwardly toward bottom 40. Motion of support panel 58 is caused by the connection to the support flange 50 afforded by panel segment 56, which pivots away from support flange 50 to assume the angular orientation depicted in FIG. 1. Support panel 58 is biased against the sidewall 16 by retaining flap 60 and moves downward until its lower edge 142 engages bottom 40, which stops its motion. Substantially simultaneously, locking tabs 76 and 78 engage recesses 80 and 82 (not shown) in inner layers 48 and 44 to lock the support flange 50 in place substantially parallel to bottom 40. Engagement of lower edge 142 with bottom 40 creates a stiff support preventing motion of panel segment 56 and creating the truss structure along with support flange 50 as depicted in FIG. 1.

Similarly, as shown in FIG. 6, support flange 52 causes support panel 64 to slide downwardly toward bottom 40. Motion of support panel 64 is caused by the connection to the support flange 52 afforded by panel segment 62, which pivots away from support flange 52 to assume the angular orientation depicted in FIG. 8. Support panel 64 is biased against the sidewall 20 by retaining flap 66 and moves downward until its lower edge 144 engages bottom 40, which stops its motion. Substantially simultaneously, locking tabs 68 and 70 engage recesses 72 and 74 (not shown) in inner layers 44 and 48 to lock the support flange 52 in place substantially parallel to bottom 40. Engagement of lower edge 144 with bottom 40 creates a stiff support preventing motion of panel segment 62 and creating the truss structure along with support flange 52 as depicted in FIG. 1.

Once loaded with merchandise and with support flanges 50 and 52 folded, a top (not shown) is placed on the container 10 and the container is ready for shipping. It is clear that the steps involved in forming the container from the knockdown, filling the container, folding the support flanges 50 and 52 in place and placing a top on the container are relatively simple steps occasioned by the design of the knockdown 124 which allows these steps to be performed rapidly and reliably by automated machinery.

Figure 10:
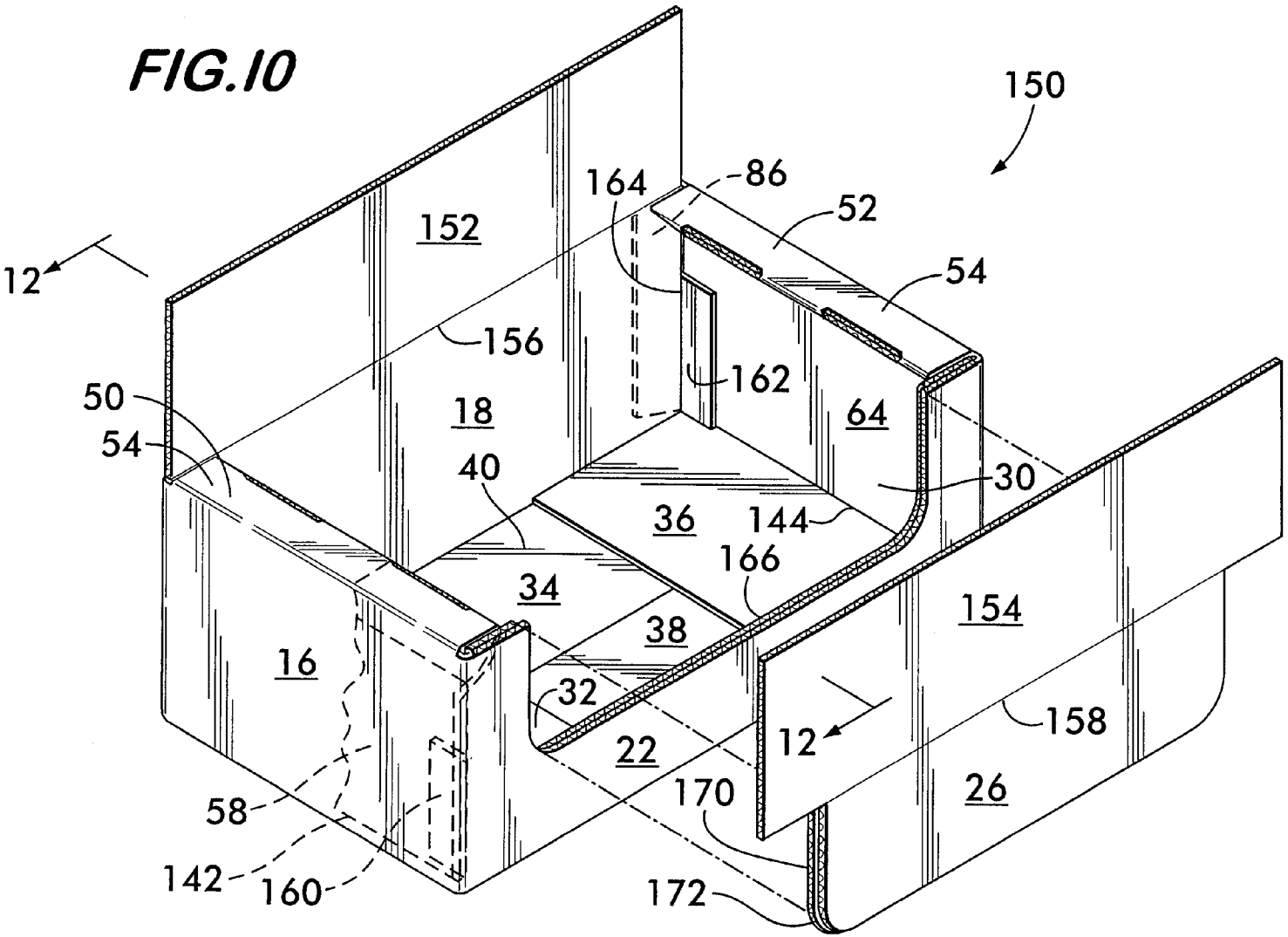
FIG. 10 is a perspective view of another embodiment of a container according to the invention.

FIG. 10 shows another embodiment 150 of a container according to the invention. Container 150 has many of the same features and structures as described above for container 10, and these features and structures are identified by the same reference characters as used for container 10.

Container 150 differs from the previously described embodiment in that it has cover flaps 152 and 154 which are attached to sidewalls 18 and 22 respectively along upper edges defined by respective fold lines 156 and 158. Cover flaps 152 and 154 are folded downwardly along fold lines 156 and 158 after the container 150 is filled and the support flanges 50 and 52 are deployed into their horizontal position, the cover flaps forming a top for the container 150. The cover flaps 152 and 154 may be sealed closed using tape, or may be adhered to the support surfaces 54 of the support flanges 50 and 52. Preferably, cover flap 152 is integrally formed with sidewall 18 and cover flap 154 is integrally formed with the opposite facing sidewall 22.

Figure 12:
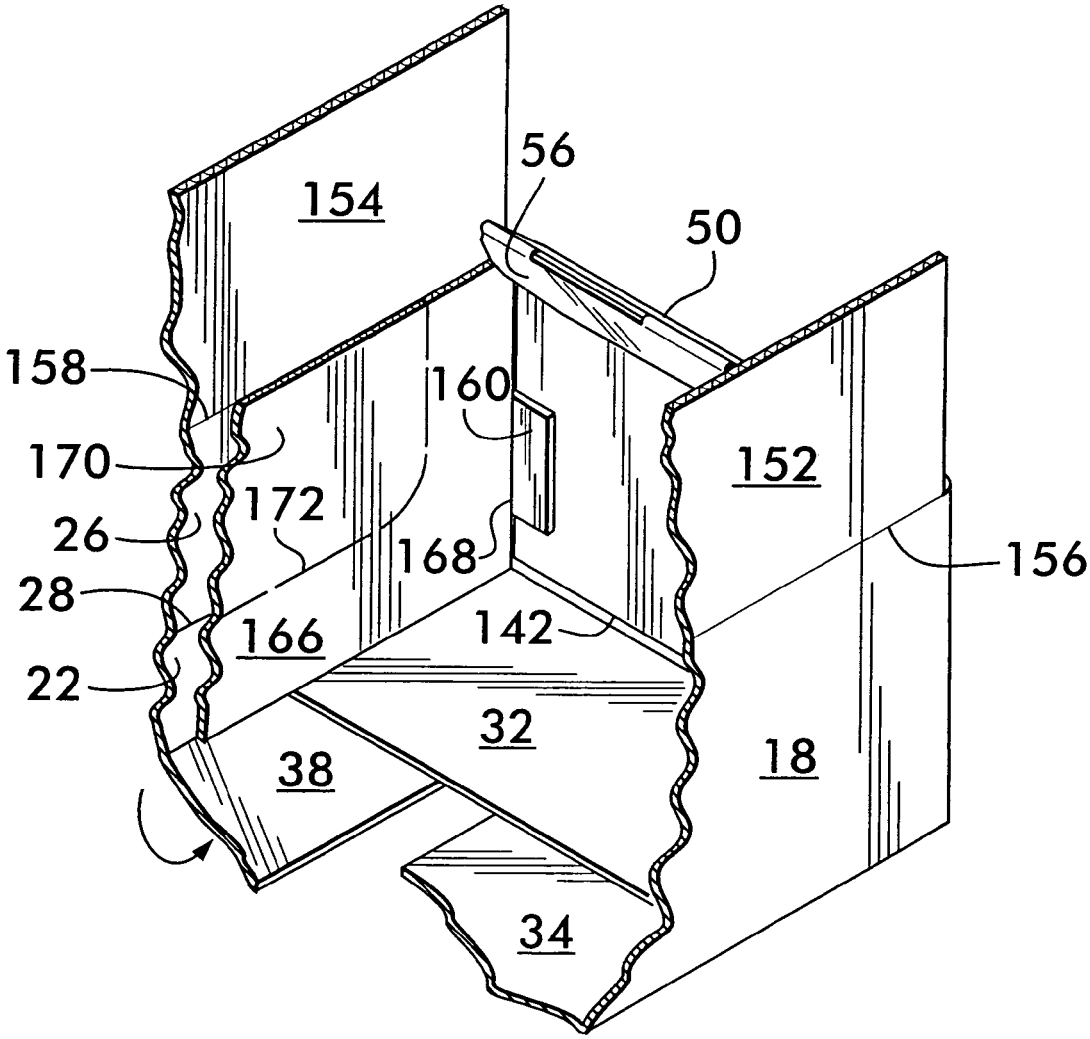
FIG. 12 is a perspective cross-sectional view taken at line 12 of FIG. 10.

Container 150 also has retaining flaps 160 and 162 which are respectively positioned in facing relation adjacent to sidewalls 16 and 20 so as to bias support panels 58 and 64 against or retain them adjacent to their respective sidewalls as they slide downwardly to position their bottom engaging edges 142 and 144 against bottom 40 when the support flanges 50 and 52 are deployed as described above. Retaining flap 162 is integrally formed with sidewall 18 along an edge adjacent to sidewall 20 and defined by a fold line 164. Due to the desire to make the container from a unitary blank 174 (shown in FIG. 2) the other retaining flap 160 is integrally formed with a secondary sidewall 166 along an edge defined by a fold line 168. As shown in FIG. 12, the secondary sidewall 166 is adhered to sidewall 22 prior to forming a knockdown from blank 174. The secondary sidewall 166 has a removable panel portion 170 defined by a series of perforations 172. The removable panel portion 170 overlies removable panel portion 26 on sidewall 22 thus allowing the opening 30 to be formed when it is desired to display the contents of the container. Note that cover flaps 152 and 154 are preferably easily removable from container 150 so as to promote display of and access to the contents in the central space 24. Cover flap 154 is preferably removed with the removable panel portion 26 as shown in FIG. 10.

Figure 11:
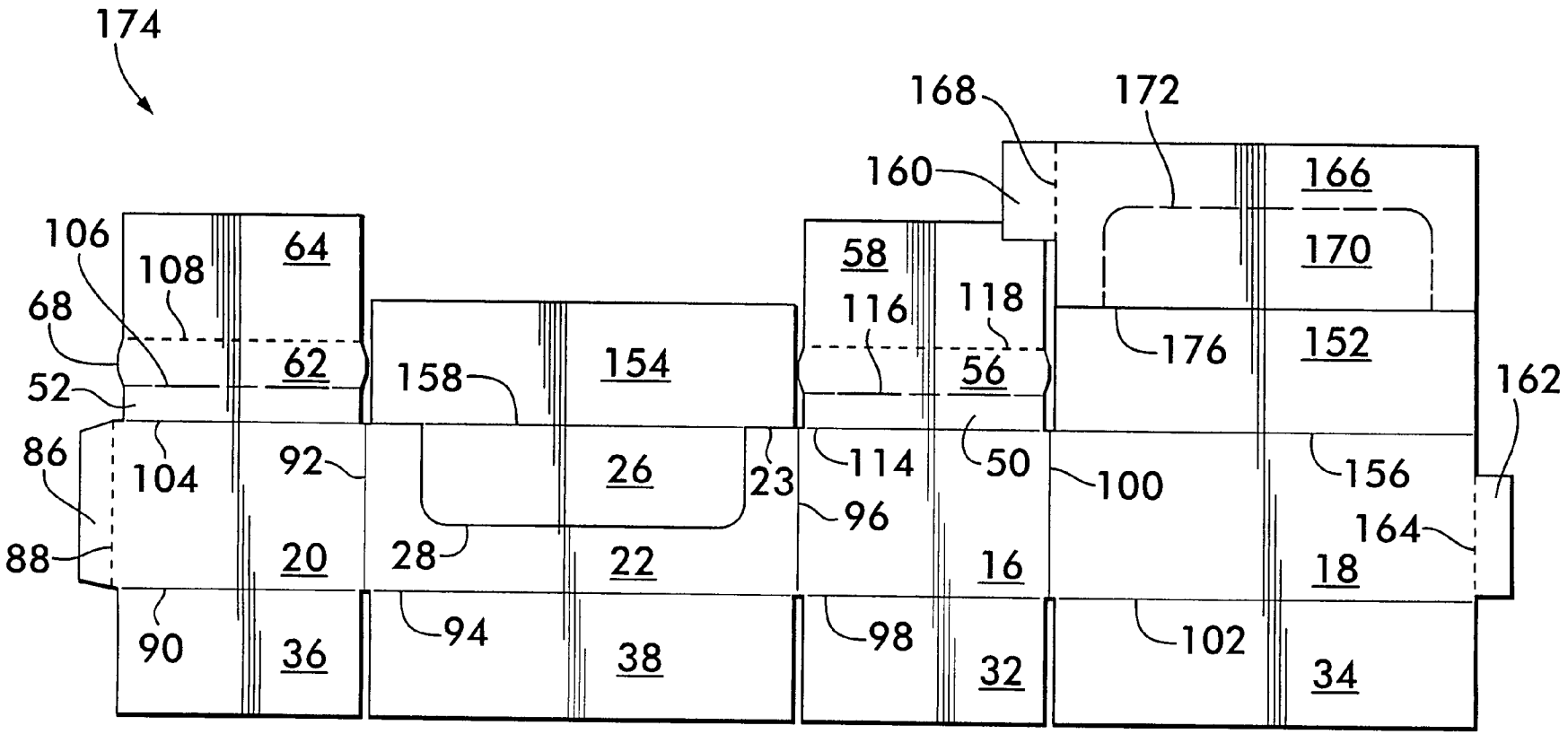
FIG. 11 is a plan view of a blank from which the container shown in FIG. 10 is formed.

FIG. 11 shows unitary blank 174 used to form the container 150. Blank 174 is preferably cut from a single sheet of corrugated paperboard. The surfaces visible in FIG. 11 face inwardly when the blank is formed into container 150. FIG. 11 clearly illustrates cover flaps 152 and 154 extending from sidewalls 18 and 22 as well as retaining flap 162 extending from sidewall 18. Secondary sidewall 166 is formed initially as a part of cover flap 152 and is severed from the cover flap along edge 176 dividing the secondary sidewall 166 from the cover flap 152. The retaining flap 160 extends from the secondary sidewall 166 along fold line 168 as described above. Note that the retaining flap 160 may encroach on the area of support panel 58 when the blank is cut from the sheet material.

In preparing a knockdown (not shown) from the blank 174 the procedure is similar to that described previously. Prior to folding the blank to form the knockdown walls the secondary sidewall 166 is separated from cover flap 152 along perforations 176 and adhered to the inside surface of sidewall 22. The secondary sidewall 166 is arranged so that the removable panel portion 170 and the perforations 172 align with the removable panel portion 26 and its defining perforations 28 so that both removable panel portions will separate cleanly from the container. The secondary sidewall 166 is also arranged so that the retaining flap 160 is positioned in overlying relation with sidewall 16 thus ensuring that both support panels 58 and 64 will be biased against their respective sidewalls 16 and 20 by respective retaining flaps 160 and 162.

Containers according to the invention provide a convenient and cost effective item for packaging, transporting and displaying bulk items. Such containers are rugged and reliably stackable and avoid the problems of nesting and collapse from which other containers suffer.

What is claimed is:

1. A container upon which another container may be stacked, said container comprising:

a plurality of panels attached to one another along adjacent edges to form a plurality of sidewalls surrounding a central space;

a plurality of flaps extending from said sidewalls to form a bottom;

a support flange attached to a first of said sidewalls along an edge thereof positioned opposite to said bottom, said support flange being oriented substantially parallel to said bottom and having an edge extending inwardly toward said central space;

a support panel positioned in overlying engagement with said first sidewall and facing said central space, said support panel having a bottom-engaging edge;

a panel segment extending angularly from said support panel and attached to said edge of said support flange, said panel segment and said support panel supporting said support flange and preventing rotation thereof toward said bottom, said support flange thereby providing support to said containers when stacked one atop another; and a locking tab extending outwardly from an edge of said panel segment adjacent to a second of said sidewalls, said second sidewall having a recess for receiving said locking tab, said support flange being lockable into said parallel orientation with said bottom upon engagement of said locking tab with said recess.

2. A container according to claim 1, wherein said support flange extends across the length of said first sidewall.

3. A container according to claim 2, wherein said second sidewall comprises first and second layers joined to one another along a fold line parallel and in spaced relation to said bottom, said layers being reverse folded along said fold line so as to be in overlying relation with one another, said first layer being attached to said first sidewall and facing outwardly from said central space, said second layer facing inwardly, said recess being positioned in said second layer.

4. A container according to claim 1, further comprising a second of said sidewalls attached to said first sidewall and oriented at a right angle thereto, and a retaining flap extending from said second sidewall substantially at a right angle thereto, said support panel being sandwiched between said retaining flap and said first sidewall, said retaining flap retaining said support panel adjacent to said first sidewall.

5. A container according to claim 4, wherein said second sidewall comprises first and second layers joined to one another along a fold line parallel and in spaced relation to said bottom, said layers being reverse folded along said fold line so as to be in overlying relation with one another, said first layer being attached to said first sidewall and facing outwardly from said central space, said second layer facing inwardly, said retaining flap extending from an edge of second layer positioned adjacent to said first sidewall.

6. A container according to claim 4, wherein said support flange is joined to said first sidewall along a first fold line defining said edge of said first sidewall, said support flange being rotatable about said first fold line between a first position wherein said support flange is co-planar with said first sidewall, and a second position wherein said support flange is oriented at a right angle to said first sidewall, said panel segment being attached to said support flange and said support panel along second and third fold lines arranged parallel and in spaced relation to said first fold line, said support panel being retained adjacent to said first sidewall by said retaining flap and sliding over said first sidewall into engagement with said bottom when said support flange moves into said orientation at a right angle to said first sidewall.

7. A container according to claim 1 and formable from a knockdown having first and second knockdown walls attached to one another at first and second knockdown corners to form a substantially flat assembly, said first knockdown wall including said first sidewall and another of said sidewalls attached to said first sidewall along one of said adjacent edges, said first knockdown wall further including said support flange, said panel segment, and said support panel all in a substantially same first plane, said second knockdown wall including said remaining sidewalls attached to one another along said adjacent edges in a second substantially same plane parallel to said first plane.

8. A container according to claim 1, further comprising:

a second support flange attached to a second of said sidewalls along an edge thereof positioned opposite to said bottom, said second sidewall being positioned in facing relation opposite to said first sidewall, said second support flange being oriented substantially parallel to said bottom and having an edge extending inwardly toward said central space;

a second support panel positioned in overlying engagement with said second sidewall and facing said central space, said second support panel having a bottom-engaging edge; and a second panel segment extending angularly from said second support panel and attached to said edge of said second support flange, said second panel segment and said second support panel supporting said second support flange and preventing rotation thereof toward said bottom, said second support flange thereby providing support to said containers when stacked one atop another.

9. A container according to claim 8, further comprising a third of said sidewalls attached to said second sidewall and oriented at a right angle thereto, and a second retaining flap extending from said third sidewall substantially at a right angle thereto, said second support panel being sandwiched between said second retaining flap and said second sidewall, said second retaining flap retaining said second support panel adjacent to said second sidewall.

10. A container according to claim 8, wherein said first and second support flanges are respectively joined to said first and second sidewalls along first and second respective fold lines defining said edges of said first and second sidewalls, said support flanges each being rotatable between a first position wherein said support flanges are respectively co-planar with said first and second sidewalls, and a second position wherein said support flanges are each oriented at a right angle respectively to said first and second sidewalls, said first and second panel segments being respectively attached to said first and second support flanges and said first and second support panels along respective third and fourth fold lines arranged parallel and in spaced relation to said first and second fold lines, said first and second support panels being respectively biased against said first and second sidewalls by said first and second retaining flaps and respectively sliding over said first and second sidewalls into engagement with said bottom when said support flanges move into said orientation at a right angle to said first and second sidewalls.

11. A container according to claim 1, wherein said support flange, said support panel, said panel segment, said sidewalls and said flaps comprise corrugated paperboard.

12. A container according to claim 11, formed from a unitary piece of said paperboard, wherein said support flange, said support panel and said panel segment is defined by fold lines formed in said paperboard.

13. A container according to claim 1, wherein said second sidewall has a removable panel portion, said removable panel portion being separable from said second panel to create an opening in said second panel providing access to said central space.

14. A container according to claim 1 and formable from a knockdown having first and second knockdown walls attached to one another at first and second knockdown corners to form a substantially flat assembly, said first knockdown wall including said first sidewall, another of said sidewalls, said first support flange, said first panel segment, said first support panel and said first retaining flap in a substantially same first plane, said second knockdown wall including said second sidewall, another of said sidewalls, said second support flange, said second panel segment, said second support panel and said second retaining flap in a second substantially same plane parallel to said first plane.

15. A container according to claim 1, further comprising:

a cover flap joined to said second sidewall along a fold line parallel and in spaced relation to said bottom, said cover flap being foldable inwardly along said fold line to form a top covering said central space.

16. Support surfaces useable on containers to permit stacking of said containers one atop another without nesting, said containers comprising a plurality of interconnected panels forming sidewalls surrounding a central space, said sidewalls having flaps extending therefrom and foldable to form a bottom, a first and a second of said sidewalls facing one another in opposing relationship, said support surfaces comprising:

first and second support flanges respectively attached to said first and second sidewalls and extending lengthwise along edges thereof in spaced relation to said bottom, said support flanges each being oriented at a right angle to said first and second sidewalls respectively and having an edge projecting inwardly toward said central space;

first and second support panels positioned respectively in overlying engagement with said first and second sidewalls, each of said support panels having a bottom engaging edge;

first and second panel segments extending respectively from said first and second support panels and respectively attached to said edges of said first and second support flanges, said panel segments and said support panels supporting said support flanges and preventing rotation thereof toward said bottom, said support flanges thereby providing support to said containers when stacked one atop another; and first and second locking tabs extending outwardly respectively from edges of said first and second panel segments adjacent to said sidewalls, said sidewalls having respective recesses for receiving said first and second locking tabs, said first and second support flanges being lockable into said parallel orientation with said bottom upon engagement of said first and second locking tabs with said recesses.

17. Support surfaces according to claim 16, wherein said support flanges, said support panels, said panel segments, said sidewalls and said flaps comprise corrugated paperboard.

18. Support surfaces according to claim 17, wherein said first and second support flanges, said first and second panel segment and said first and second support panels are integrally formed with said first and second sidewalls respectively.

19. Support surfaces according to claim 18, wherein said containers are formed from a knockdown having first and second knockdown walls attached to one another at first and second knockdown corners to form a substantially flat assembly, said first knockdown wall including said first sidewall, said first support flange, said first support panel, said first panel segment, and one of said adjacent sidewalls attached to said first sidewall, all located in a substantially same first plane, said second knockdown wall including said second sidewall, said second support flange, said second support panel, said second panel segment, and another of said sidewalls attached to said second sidewall, all located in a substantially same second plane parallel to said first plane.

20. A container upon which another container may be stacked, said container comprising:

a plurality of panels attached to one another along adjacent edges to form a plurality of sidewalls surrounding a central space;

a plurality of flaps extending from said sidewalls to form a bottom;

a support flange attached to a first of said sidewalls along an edge thereof positioned opposite to said bottom, said support flange being oriented substantially parallel to said bottom and having an edge extending inwardly toward said central space;

a support panel positioned in overlying engagement with said first sidewall and facing said central space, said support panel having a bottom-engaging edge;

a panel segment extending angularly from said support panel and attached to said edge of said support flange, said panel segment and said support panel supporting said support flange and preventing rotation thereof toward said bottom, said support flange thereby providing support to said containers when stacked one atop another, said panel segment being separated from each of said support flange and said support panel by a respective fold line; and a retaining flap extending from said inner layer of said second sidewall, said retaining flap being positionable at substantially at a right angle to said second sidewall to sandwich said support panel between said retaining flap and said first sidewall, said retaining flap thereby retaining said support panel adjacent to said first sidewall;

wherein a second of said sidewalls comprises an outer layer joined to said first sidewall and an inner layer attached to said outer layer along a fold line, said inner layer having a width less than a respective width of said outer layer.

21. A container according to claim 20, said panel segment further comprising a locking tab extending outwardly from an edge of said panel segment and beyond an edge of said support flange, a second of said sidewalls having a recess for receiving said locking tab, said support flange being lockable into said parallel orientation with said bottom upon engagement of said locking tab with said recess.

* * * * *